United States Patent [19]

Tennis

[11] 4,178,962

[45] Dec. 18, 1979

[54] CONTROL VALVE WITH FLOW CONTROL MEANS

[75] Inventor: Francis H. Tennis, Oconomowoc, Wis.

[73] Assignee: Tomco, Inc., Racine, Wis.

[21] Appl. No.: 302,594

[22] Filed: Oct. 30, 1972

[51] Int. Cl.[2] ..... F15B 13/02

[52] U.S. Cl. ..... 137/596.13; 60/462; 91/436; 91/446; 91/452; 137/596.1

[58] Field of Search ..... 137/596.1, 596.12, 596.13, 137/115; 60/462; 91/436

[56] References Cited

U.S. PATENT DOCUMENTS

| | | | |
|---|---|---|---|
| 2,255,787 | 9/1941 | Kendrick | 137/501 X |
| 2,837,107 | 6/1958 | Rockwell | 137/115 X |
| 2,965,133 | 12/1960 | Rice et al. | 137/596.2 X |
| 3,145,734 | 8/1964 | Lee et al. | 137/596.13 |
| 3,229,717 | 1/1966 | Rice | 137/596.12 |
| 3,304,953 | 2/1967 | Wickline et al. | 137/596.12 |
| 3,488,953 | 1/1970 | Haussler | 137/596.13 X |
| 3,613,711 | 10/1971 | Wilke | 137/115 |
| 3,675,676 | 7/1972 | O'Conner et al. | 137/501 |
| 3,771,558 | 11/1973 | Ailshie | 137/596.13 |
| 3,788,077 | 1/1974 | Johnson | 60/452 |
| 4,139,021 | 2/1979 | Ailshie et al. | 137/596.13 |

FOREIGN PATENT DOCUMENTS

| | | | |
|---|---|---|---|
| 718255 | 9/1965 | Canada | 137/596.2 |
| 656622 | 8/1951 | United Kingdom | 137/596.12 |

*Primary Examiner*—Gerald A. Michalsky
*Attorney, Agent, or Firm*—Ira Milton Jones

[57] ABSTRACT

An open center type control valve for a hydraulic motor, wherein pressure fluid from a source is caused to flow from the valve inlet to a motor port at a substantially uniformly metered rate despite fluctuations in the load on the governed fluid motor, due to the operation of a flow control mechanism which regulates bypass of excess fluid through the open center passage to the valve outlet in accordance with variations in the pressure differential between the inlet and outlet end portions of the open center passage.

15 Claims, 8 Drawing Figures

CONTROL VALVE WITH FLOW CONTROL MEANS

This invention relates to control valves for hydraulic cylinders or other fluid motors, and it has more particular reference to control valves of the type having provision for maintaining the governed motor in operation at a substantially constant speed corresponding to the particular metering setting of the valve spool governing operation of said motor, despite variations in the load on the motor.

So-called pressure compensated valves are examples of the type of control valve herein concerned. Conventional valves of this nature are provided with a pressure compensated valve plunger the opposite ends of which project into pressure chambers one of which contains a spring to yieldingly urge the plunger toward a pump loading position. Pump fluid entering the valve inlet is led into the other chamber to exert opposing force upon the plunger and hold the same in a pump unloading or bypass position for as long as an associated valve spool remains in its neutral position.

When the valve spool is shifted to a partial operating position at which pump fluid flows to the selected motor port through an orifice defined in part by the spool and in part by a portion of the valve body, only a limited or metered amount of inlet fluid can flow to the selected motor port. The compensating plunger then acts to maintain said metered flow of fluid to the motor constant, despite fluctuations in the load on the motor, to thereby assure operation of the motor at a speed corresponding to the metering setting of the control spool. The plunger performs in that fashion because that end thereof which projects into the spring chamber is subjected to the pressure of fluid prevailing at the selected motor port. This is to say that the plunger is caused to move back and forth to regulate fluid flow to the motor in accordance with variations in the pressure differential across the orifice through which pump fluid flows to the motor port.

Hence, any decrease in motor load will produce a corresponding increase in said pressure differential and the plunger will respond thereto by moving in the direction to reduce the pressure at the upstream side of the orifice and thus restore the pressure differential across the orifice that exists when fluid is flowing to the motor at the desired rate. However, if the load on the governed motor should increase, said pressure differential across the orifice will decrease, and the compensating plunger will respond by moving in the direction to increase the pressure at the upstream side of the orifice to thus again restore the desired differential in pressure between its upstream and downstream sides.

While pressure compensated valves such as described can be made to function in a satisfactory manner, they are often quite complicated. In most cases they are built into the control valve with which they are used, thus requiring a specially designed and expensive body for the valve.

With this in mind, it is an objective of this invention to provide flow control means for a control valve, which will govern motor speed in a manner comparable to conventional pressure compensated control valves, but which features greater simplicity of design, versatility, and lower cost of production.

Another objective of the invention resides in the provision of a control valve with flow control means which, like a conventional pressure compensated valve, will not only improve throttle action and substantially extend throttle range regardless of pressure, but will also effect reduction in axial flow forces on the control spool to a relatively fixed low value such as will enable lighter centering springs to be used on the spool.

Still another object of the invention is to provide a flow regulating mechanism for control valves which can be readily used with conventional control valves and which, if desired can be made as an attachment for existing control valves.

In another sense, this invention has as its objective the provision of flow regulating mechanism for hydraulic control valves, which relies upon a new approach to the problem of regulating the speed of the governed fluid motor.

In this respect, it is the purpose of this invention to provide a flow regulating mechanism for open center type control valves which is operable to maintain the flow of pump fluid to a cylinder or other fluid motor at a substantially uniform metered rate by maintenance of a constant pressure differential between upstream and downstream portions of the open center passage in the control valve.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate examples of several embodiments of the invention constructed according to the best modes so far devised for the practical application of the principles thereof, and in which.

Figure 1:
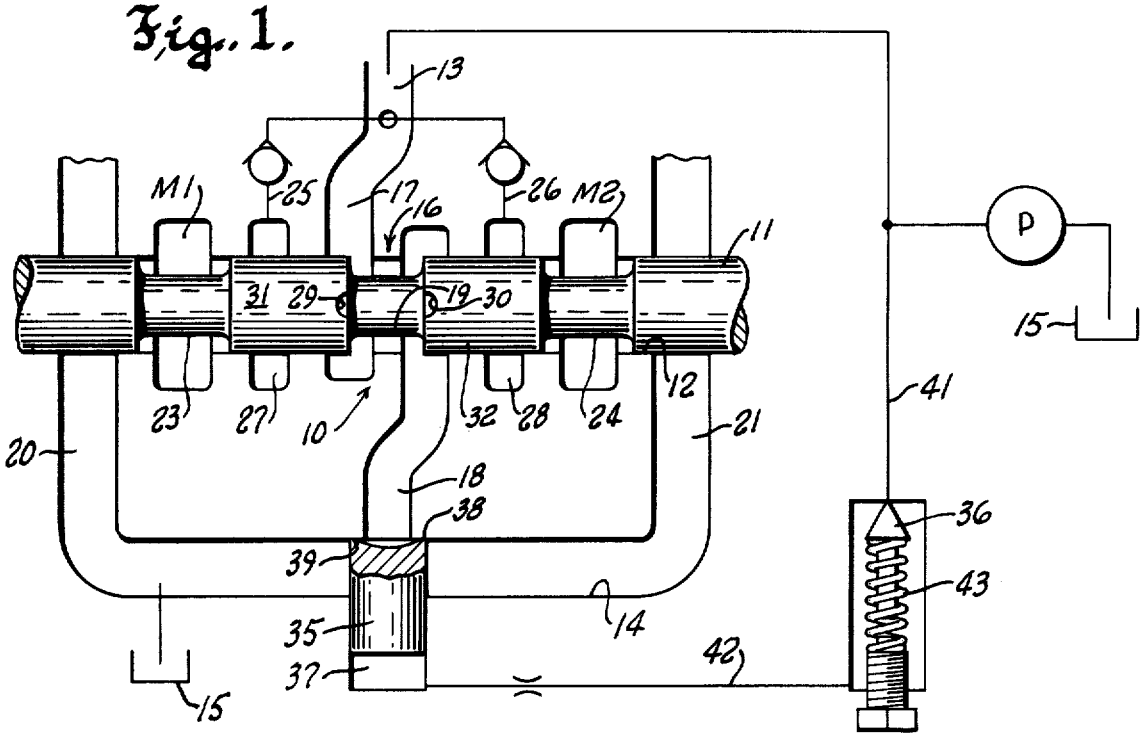
FIG. 1 is a diagrammatic view of an open center type control valve equipped with a substantially balanced poppet type of flow control mechanism of this invention.

Referring now to the accompanying drawings, the numeral 10 in FIG. 1 designates an open center type of hydraulic control valve having a control spool 11 slidable axially in a bore 12 from a neutral position such as shown, to operating positions at either side of neutral. In either of said operating positions, the spool diverts pressure fluid from an inlet 13 to a selected one of a pair of motor ports M1, M2, and directs motor exhaust fluid received in the non-selected motor port to a low pressure or return passage 14 for flow to a reservoir indicated at 15.

The valve spool 11 extends across the open center passage 16 in the valve which, in the single spool valve illustrated, has an upstream branch 17 connecting with the inlet 13 and a downstream branch 18 leading to the return passage 14. As is customary the branches of the open center passage intersect the bore 12 at axially spaced zones and are communicated with one another by the valve spool 11 in the neutral position thereof through a circumferential groove 19 in the spool. A centering spring mechanism, not shown, normally holds the spool in this neutral position at which pump fluid entering the inlet 13 of the valve flows substantially freely through the open center passage 16 to the return passage 14.

In the valve shown, the return passage 14 has two branches 20 and 21 which intersect the bore 12 equal distances to opposite sides of the open center passage 16 and outwardly adjacent to the motor ports M1 and M2 respectively; and the valve spool has two other circumferential grooves 23 and 24 therein which normally register with said ports. Feeder passages 25 and 26 connecting with the inlet 13 respectively lead to pressure wells 27 and 28 which intersect the bore 12 at opposite sides of the open center passage, between it and the motor ports M1 and M2.

In either operating position thereof, the valve spool communicates the inlet 13 with the selected motor port through its adjacent pressure well and the feeder passage 25 or 26 connecting therewith. Pressure fluid from the inlet will flow to the selected motor port in an amount depending upon how much inlet fluid is allowed to flow past the valve spool to the return passage 14 via the open center passage 16. As is customary, the open center passage is completely blocked by the valve spool in either full operating position thereof, in which case all of the inlet fluid is constrained to flow to the selected motor port for operation of a motor connected with ports M1 and M2 at full speed.

Operation of the governed motor at less than full speed requires the valve spool to be placed in a partial operating position at which some of the inlet fluid is allowed to flow past the valve spool to the downstream branch of the open center passage, thus constraining the balance to flow to the selected motor port. Throttle notches 29 and 30 are formed in the opposing ends of the spool lands 31 and 32, respectively, which define the groove 19, to facilitate metering of the amount of inlet fluid allowed to bypass the valve spool for operation of the motor at a speed determined by the setting of the spool. For convenience the area of the opening or orifice through which inlet fluid thus flows to the downstream branch of the open center passage, via the spool groove 19 and/or the notches 29 or 30, will be hereinafter referred to as the neutral throttle.

The remote ends of the lands 31 and 32 also cooperate with the body lands between the feeder wells and the motor ports to define orifices through which working fluid must flow to reach the motor ports. For convenience, the area of the orifice through which working fluid thus flows to the motor ports can be referred to as the high pressure throttle, even though this high pressure throttle may be located at the upstream end of the feeder passage 25, 26, as is the case in some valve constructions.

It will be understood, of course, that the so-called land timing is such that upon shifting of the valve spool toward any operating position thereof, the selected motor port will be in communication with its associated pressure well 27 or 28 before pump pressure in the inlet 13 can build up to a value great enough to unseat the high pressure relief valve (not shown) customarily used with control valves of this type.

In the past, such control valves were provided with various kinds of pressure compensating valve mechanisms all of which operated on the same principle of regulation of the amount of fluid diverted to the selected motor port in accordance with variations in the pressure differential across a high pressure throttle such as described, brought about by change in the loading on the governed fluid motor. As a general rule, such pressure compensating valves were comprised of a valve plunger operable in response to said pressure differential, for dividing the flow of inlet fluid between the selected motor port and an exhaust passage in proportions depending upon the setting of the valve spool.

The present invention also provides flow control means for maintaining the governed motor in operation at a substantially constant speed despite variations in the load thereon, but takes a different approach to that problem. In essence, it ignores a high pressure throttle and instead effects regulation of fluid flow to the selected motor port in accordance with variations in the pressure differential across the neutral throttle.

In that form of the invention seen in FIG. 1, the flow control mechanism comprises a balanced poppet 35 and a low pressure relief valve 36. The poppet is axially slidable in a pressure chamber 37, which can be vented in any suitable way to allow the poppet to open on demand, for example, by providing a certain amount of relief clearance around the exterior of the poppet. The poppet is movable toward and from engagement of its outer end 38 with an annular valve seat 39 at the outlet end of the downstream branch 18 of the open center passage. If desired, the poppet can be lightly biased toward its closed position. Fluid in said downstream open center branch 18, of course must flow through the seat 39 in order to reach the return passage 14.

Hence, when the poppet is in engagement with the seat 39, it blocks flow of fluid to the return passage 14 from the outlet branch 18 of the open center passage; but pressure fluid in the latter can act upon the outer end 38 of the poppet to unseat the same, partially or fully, whenever the force it exerts upon the poppet exceeds the force which pressure fluid in the chamber 37 exerts upon the inner end of the poppet.

The low pressure relief valve 36 has its inlet in communication with the pump delivery port and hence with the inlet 13 of the control valve, by means of a duct 41. Its outlet is communicated with the pressure chamber 37 by a duct 42. In operation, its spring 43 would be adjusted so as to hold the low pressure relief valve closed until the pump inlet is in communication with the selected motor port. Merely by way of example, the spring 43 can be adjusted to cause the valve to relieve whenever the pressure at the inlet 13 of the control valve reaches 200 psi. With this setting of the low pressure relief valve, the pressure in the poppet chamber 37 will always be 200 psi less than the pressure of fluid at the inlet 13 of the control valve in any operating position of its spool 11. In the neutral position of the spool, of course, all of the pump output fluid will flow at little or no pressure through the open center passage 16 to the return passage 14 without interference from the poppet 35.

If the governed motor is to be operated at less than full speed in consequence of flow of a metered amount of pressure fluid thereto from motor port M1, the valve spool must be moved to a partial operating position to the right of neutral an extent, for example, such that its land 31 is brought only slightly into that portion of bore 12 which joins the inlet and outlet branches of the open center passage 16. Reference may be had to the valve of FIG. 4, the spool of which is shown in such a metering position; but it should be understood that metering can also take place when the valve spool is in a position allowing some of the inlet fluid to flow to the downstream branch of the open center passage through an orifice defined in part by the spool groove 19.

Figure 4:
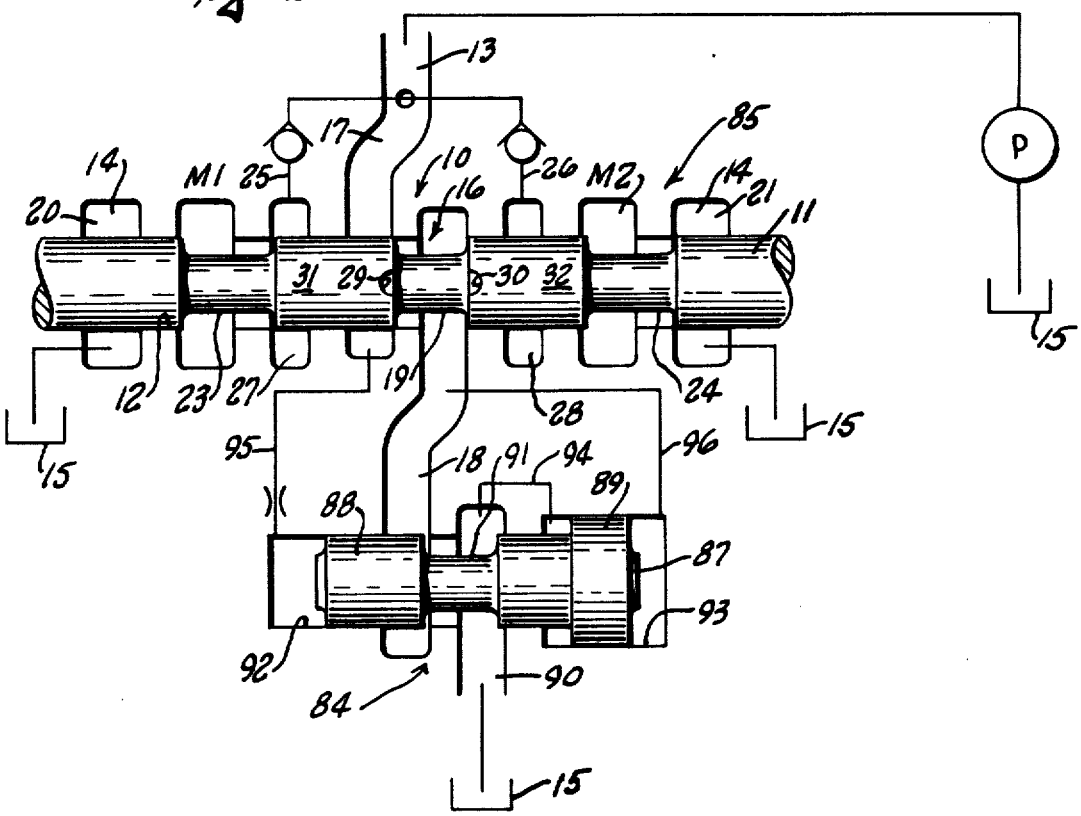
FIG. 4 is a diagrammatic view of a control valve on the order of that seen in FIG. 1, but illustrating a spool type flow control mechanism of this invention.

In a position of the spool such as seen in FIG. 4, some of the inlet fluid flows past the valve spool to the outlet branch 18 of the open center passage, through an orifice defined by the throttle notch (or notches) 29. Such restriction of the open center passage by the valve spool produces a quick build up in inlet pressure to a value in excess of the 200 psi setting of the low pressure relief valve, so that pump output fluid will then flow into the chamber 37 and exert closing force on the poppet 35. Because of the low pressure relief valve 36, the pressure of pump fluid in the inlet 13 will be 200 psi greater than that of fluid in chamber 37 in any operating position of the valve spool; which is to say that the relief valve tends to maintain a 200 psi pressure drop across the neutral throttle.

As soon as closing force is applied to the poppet 35 in this manner the inlet pressure quickly rises to a value great enough to overcome the load on the governed cylinder and pressure fluid then flows from the inlet through feeder passage 25 and to pressure well 27 then in communication with motor port M1 through the groove 23 in the valve spool.

In hydraulically operated material handling equipment such as front end loaders, backhoes and the like, cylinder loading is apt to fluctuate over a wide range, and the speed of cylinder operation could not be held at a desired uniform rate in the absence of some form of flow control means that functions to regulate the rate at which pressure fluid flows to the governed cylinder or cylinders in accordance with changes in the loading thereon.

In the present case, if the load on the cylinder governed by valve spool 11 should increase, the resulting rise in pressure in the motor port M1 is manifested in a corresponding rise in the pressure of fluid in the inlet 13 and in the upstream branch 17 of the open center passage 16, relative to the pressure in the outlet branch 18 of said passage. Along with this rise in inlet pressure, there will be a corresponding rise in pressure in the poppet chamber 37 relative to the pressure in the outlet branch 18 of the open center passage, with the result that the poppet will be moved toward closed position an extent such as to further restrict communication between the outlet passage 14 and the outlet open center branch 18 and cause the pressure in the latter to build up to a value necessary to restore the 200 psi pressure drop across the neutral throttle. Because bypass flow is thus controlled and regulated, the excess pump fluid available to the motor must remain substantially constant.

In the event the load on the cylinder should decrease, the pressure drop across the neutral throttle will also decrease due to the resulting drop in pressure in the inlet branch 17 of the open center passage, relative to the pressure in the outlet branch 18 thereof. The reduced inlet pressure, of course, produces a corresponding drop in the pressure of fluid in the poppet chamber 37, and the poppet will be moved in the opening direction under force exerted on its outer end by fluid in the outlet branch 18 of the open center passage to relieve pressure therein to an extent such as to restore the 200 psi pressure drop across the neutral throttle.

Hence it will be apparent that the low pressure relief valve 36 cooperates with the poppet 35 in any metering position of the valve spool to maintain a uniform pressure drop across the neutral throttle and to keep the flow of pressure fluid to the governed motor at a constant rate for operation of the motor at the desired uniform speed despite variations in the load thereon.

Figure 2:
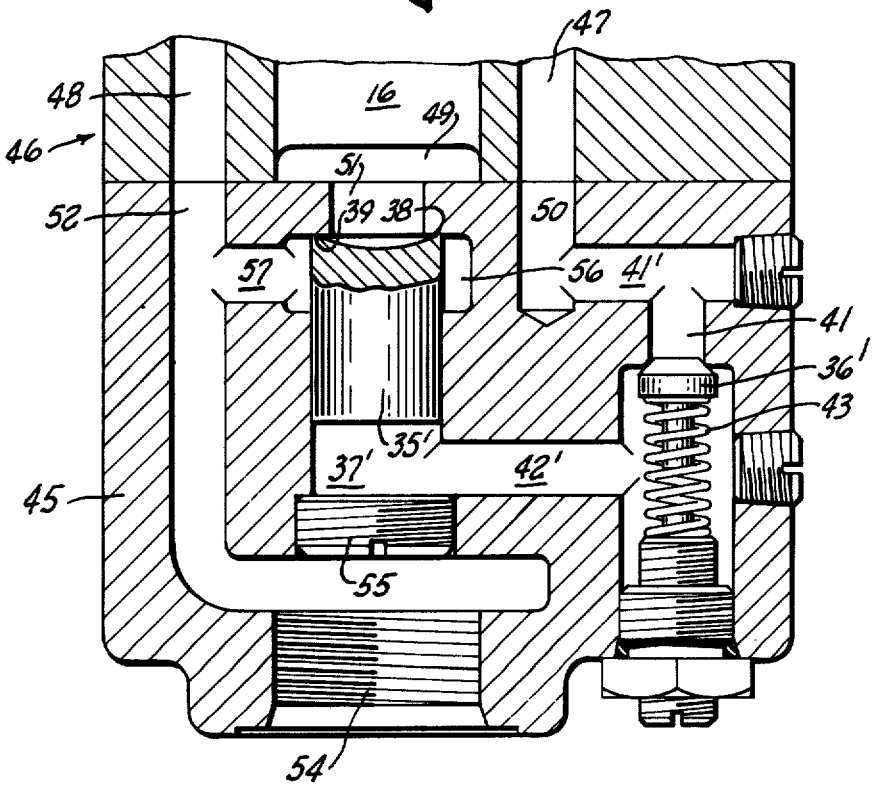
FIG. 2 is a detail view, in section, showing how a similar flow control mechanism can be embodied in a housing that can be attached to the body of a conventional control valve, and which can comprise the outlet section for a control valve of sectional construction.

If desired, the poppet and low pressure relief valve can be mounted in a common housing 45, as seen in FIG. 2. The housing can comprise the outlet section of a control valve 46 of sectional construction on the order of that disclosed in Tennis U.S. Pat. No. 3,134,402 issued May 26, 1964, substantially without modification of the valve of that patent. Thus, the feeder passage 47 thereof already opens to the underside of the final control section of the bank, as does the exhaust passage 48 and the outlet branch 49 of the open center passage.

It will be seen, therefore, that the housing 45 will require three passageways 50, 51 and 52 which open to the top of the housing, in register with the feeder passage 47, the open center outlet branch 49, and the exhaust passage 48, respectively. The passage 50 is thus communicated with the inlet (not shown) of the control valve through the feeder passage 47, and it is also communicated with the inlet of the low pressure relief valve 36' by duct means 41' in the housing. The exhaust passage 52 opens to a reservoir port 54 in the bottom of the housing; and the poppet 35' operates in a chamber 37' in axial alignment with the reservoir port but separated from it by means of a plug 55.

The passage 51 opens downwardly to an enlarged upper portion 56 of the poppet chamber, and said upper chamber portion is communicated with the exhaust passage 52 by a short lateral passageway 57. Another passageway 42' in the housing communicates the outlet of the relief valve with the chamber 37'.

Until a spool of the control valve is actuated to an operating position, the low pressure relief valve will remain closed, and pump fluid entering the inlet of control valve will normally issue from the outlet branch 49 of its open center passage and unseat the poppet 35' to flow substantially unrestrictedly to the exhaust passage 52.

Again assuming for purposes of illustration that the low pressure relief valve is adjusted to relieve at 200 psi, the chamber 37' will be pressurized by fluid at a pressure value which will be 200 psi less than that present in the feeder passage 47 and hence in the inlet of the control valve during operation of a fluid motor governed thereby. In other words, the desired 200 psi pressure differential will be maintained across the neutral throttle in the manner described hereinbefore.

Figure 3:
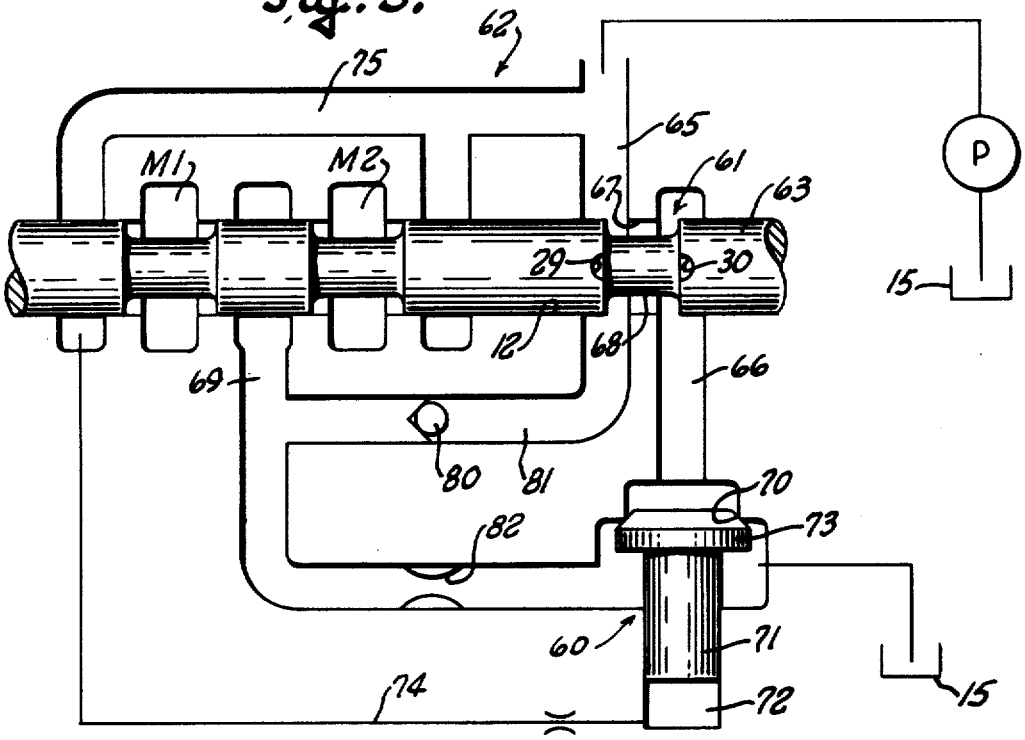
FIG. 3 is a diagrammatic view of a control valve equipped with an unbalanced poppet type flow control mechanism of this invention.

In the embodiments of the invention described thus far, a balanced poppet cooperates with an adjustable low pressure relief valve to maintain the desired pressure drop across the low pressure throttle. Substantially the same results can be achieved using an unbalanced poppet 60 at the outlet end of the open center passage 61 in the control valve 62, as seen in FIG. 3. In this latter case, however, the need for a low pressure relief valve is obviated due to the unbalanced nature of the poppet.

The control valve 62 shown in FIG. 3 has a valve spool 63 to control communication between passages arranged somewhat differently than in the FIG. 1 embodiment of the invention, but it controls the flow of fluid to a pair of motor ports M1 and M2 in the same way as before. The open center passage 61 also comprises an inlet or upstream branch 65 and an outlet or downstream branch 66 normally communicated with the inlet branch through the spool bore 67 and a circumferential groove 68 in the spool. An exhaust passage 69 intersecting the bore 67 at a location between the two motor ports returns motor exhaust fluid to the reservoir, as before. The outlet branch 66 of the open center passage also communicates with the exhaust passage 69 through an annular valve seat 70.

The unbalanced poppet 60 has a stem 71 which operates in a pressure chamber 72, with relief clearance around its exterior; and it has an enlarged head 73 which is cooperable with the seat 70.

Pressure fluid in the outlet branch 66 of the open center passage normally acts upon the enlarged head of the poppet to exert opening force thereon of a magnitude proportional to the area of its enlarged head. The chamber 72 is also maintained at a pressure corresponding to pump output pressure, and for this purpose it has been shown connected by a duct 74 with a feeder passage 75 that is communicated with the inlet branch 65 of the open center passage.

By proper proportioning of the poppet stem and head diameters, it is possible to achieve the desired pressure differential across the neutral throttle, as in the first described embodiment of the invention.

Another feature of the valve mechanism shown in FIG. 3 is that provision is made for the relief of voids in the expanding end of a governed hydraulic cylinder in the event the load thereon takes over the drive of the cylinder from the pump. At such times, the pump is unable to supply pressure fluid to that motor port of the control valve which is connected with the expanding end of the cylinder, and fluid is expelled from its contracting end at an excessive rate. The pressure in the inlet branch 65 of the open center passage then drops to a value below the rising pressure of fluid in the exhaust passage 69. When that condition exists, fluid at load induced pressure in the exhaust passage 69 unseats a check valve 80 in a duct 81 connecting the exhaust passage with the inlet branch of the open center passage, and flows to the feeder passage connected therewith to be supplied to the expanding end of the cylinder along with pump output fluid entering the control valve inlet.

The duct 81 and check valve 80 is an optional feature which, however, can be quite useful in control valves and especially those with spools having a float position, to keep adequate pump pressure, in float, regardless of the loading on the cylinder. A choke or restriction 82 in the return passage 69 is preferably used when the check valve controlled duct 81 is provided.

The flow control mechanism 84 in the FIG. 4 embodiment of the invention is illustrated in conjunction with a hydraulic control valve 85 like that disclosed in FIG. 1 with the exception that its valve spool 11 is shown as occupying a partial operating or flow metering position. In that position, pump fluid entering the inlet 13 of the control valve flows in part through the throttle notch 29 to the outlet branch 18 of the open center passage 16 and in part through feeder passage 25 to motor port M1 through the groove 23 in the spool. Fluid returning to motor port M2 flows through the spool groove 24 to the exhaust passage 21.

The flow control mechanism 84 will maintain fluid flow to motor port M1 at a substantially constant rate despite fluctuations in the load on the governed motor, but it differs from those described earlier in that it comprises an unbalanced axially slidable spool valve 87 having opposite end portions 88 and 89 of different diameters. Communication between the outlet branch 18 of the open center passage and the exhaust outlet 90 is afforded by means of a circumferential groove 91 in the spool valve 87.

The small diameter portion 88 of the spool valve is received in a bore 92, with relief clearance around its exterior; while its larger diameter portion 89 operates in a counterbore 93, also with relief clearance around its circumference. The bore 92 and counterbore 93 are closed so as to provide pressure chambers or cylinders in which the opposite end portions of the spool valve serve as pistons. The inner end of the counterbore 93 can be vented to the exhaust outlet 90 as by means of a duct 94.

The closed end of the bore 92 is communicated by a duct 95 with the inlet branch 17 of the open center passage; and the outer end of the counterbore 93 is communicated by a duct 96 with the outlet branch 18 of the open center passage. In this way, the spool valve is also made responsive to load produced variations in the pressure differential across the neutral throttle (orifice 29) through which inlet fluid flows to the outlet branch of the open center passage; and it will be caused to move axially to either restrict or increase fluid flow to the exhaust outlet 90 from the outlet branch 18 of the open center passage in order to maintain the desired pressure drop across the neutral throttle.

It is believed to be apparent that the spool valve 87 is unbalanced in substantially the same way and for the same purpose as the unbalanced poppet illustrated in FIG. 3; and that the need for a low pressure relief valve is obviated because of its unbalanced configuration.

Figure 5:
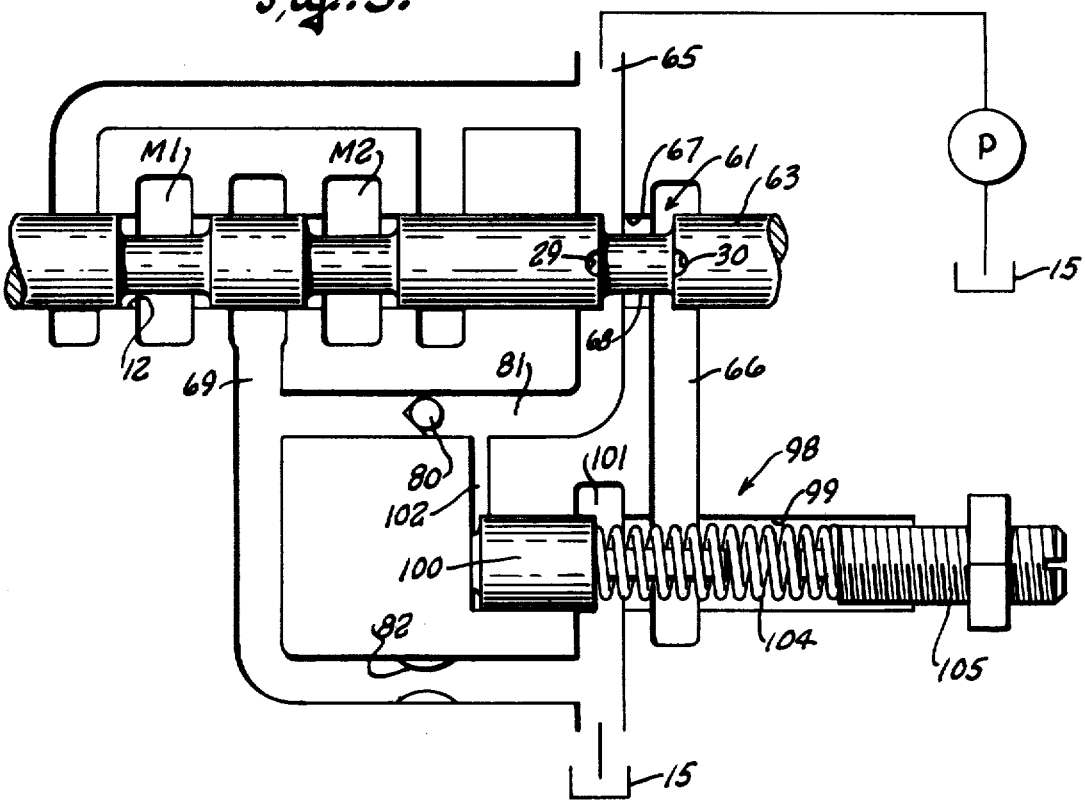
FIG. 5 illustrates how a control valve like that of FIG. 3 can be equipped with still another form of flow control mechanism.
Figure 6:
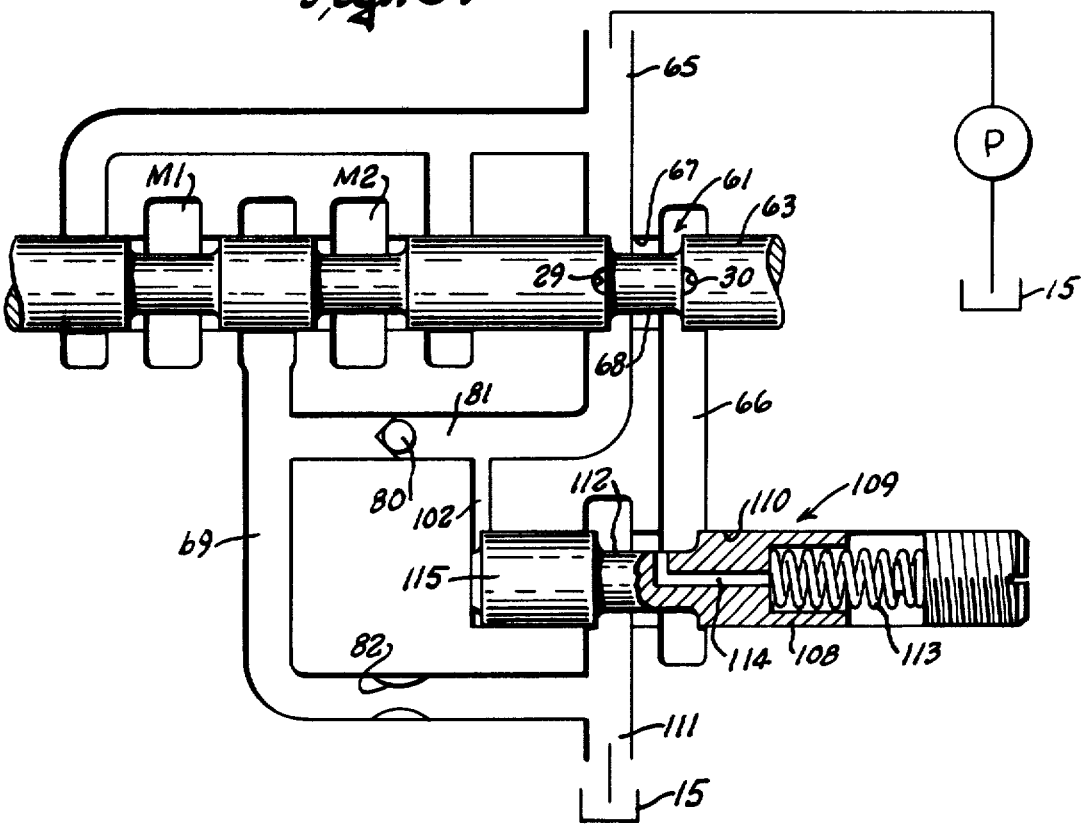
FIG. 6 is a diagrammatic view illustrating a control valve like that seen in FIG. 5, but showing how another spool type of flow control mechanism can be used to advantage therewith.

FIGS. 5 and 6 diagrammatically illustrate a single spool control valve on the order of that disclosed in FIG. 3, with somewhat different forms of flow control mechanisms for maintaining a constant pressure differential across the neutral throttle in any flow metering position of the valve spool.

The flow control mechanism 98 seen in FIG. 5 comprises an elongated bore 99 which intersects the outlet branch 66 of the open center passage 61 and a laterally adjacent outlet passage 101. The bore 99 is closed at its opposite ends to provide pressure chambers thereat. A valve plunger 100 is axially slidable in the bore from a wide open position of engagement with the left hand end of the bore, toward the opposite end of the bore to increasingly restrict fluid flow through the bore from the outlet branch 66 of the open center passage 61 to the exhaust outlet 101. The left hand end of bore 99 is communicated as at 102 with the inlet branch 65 of the open center passage, so that the plunger 100 will be subjected to closing force by pump fluid in the inlet of the control valve.

A spring 104 is confined between the other end of the plunger and an adjusting screw 105, so as to normally yieldingly hold the plunger in its wide open position shown.

The function of the spring 104 can be compared to that in the low pressure relief valve of the FIG. 1 embodiment of the invention. In each case, pump output fluid must overcome a spring force of 200 psi for example, before it can effect flow restricting movement of the poppet, or of the plunger 100. Accordingly, the behavior and response of the biased plunger to load produced variations in the pressure differential across the neutral throttle will be similar to that of the poppet seen in FIG. 1.

The same can be said of the spring biased spool valve 108 in the flow control mechanism 109 shown in the FIG. 6 embodiment of the invention. As therein seen, the spool valve 108 is axially slidably received in a bore 110 which has closed ends and which intersects an exhaust outlet passage 111 at a location adjacent to the junction between the bore and the outlet branch 66 of the open center passage 61. A circumferential groove 112 in the spool valve 108 normally fully communicates the outlet branch 66 of the open center passage with the outlet passage 111.

The spool valve 108 is yieldingly urged by a spring 113 toward a fully open position of engagement with the left hand end of the bore. That end of the bore is communicated as at 102 with the upstream or inlet branch 65 of the open center passage, while the opposite end of the bore is communicated with the outlet branch 66 of the open center passage by means of a passageway 114 in the spool valve itself.

The land 115 on the left hand end of the spool valve 108 is the equivalent of the plunger 100 in the preceding embodiment of the invention, in that it controls the degree of communication between the outlet branch 66 of the open center passage and the exhaust outlet 111 during response of the spool valve to variations in the pressure differential across the neutral throttle (notches 29 or 30) in any metering position of the valve spool 63.

Figure 7:
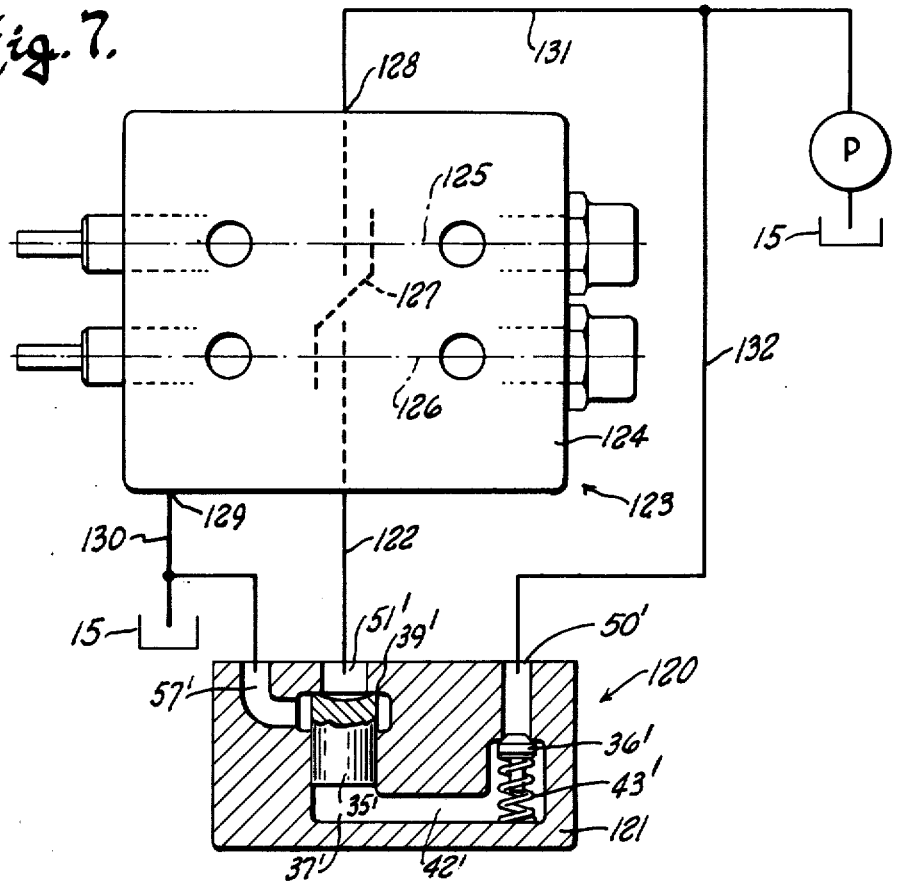
FIGS. 7 and 8 are diagrammatic views illustrating flow control valves of this invention used in combination with plural spool series-parallel type control valves.
Figure 8:
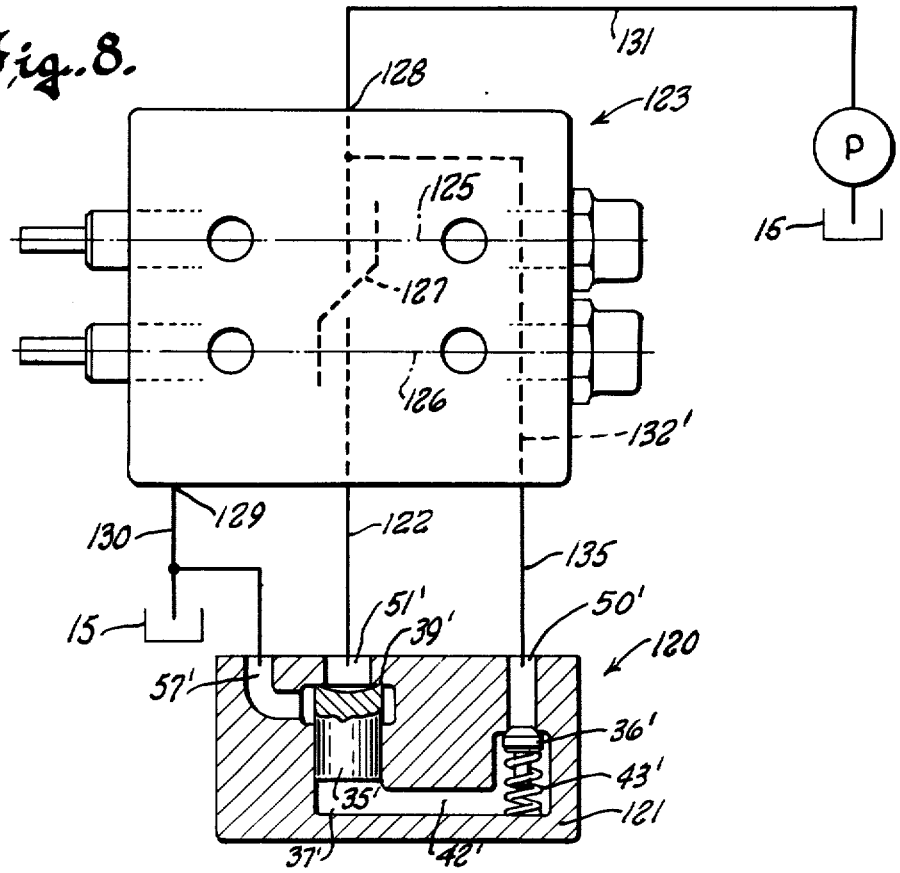

FIGS. 7 and 8 diagrammatically illustrate how a self contained flow control mechanism 120 can be used as an accessory unit in combination with the usual fixed displacement pump and a conventional control valve here shown as of the plural spool type, to achieve the motor speed controlling feature afforded by this invention. The control valves can be of either the parallel or series-parallel (priority) type, or even a combination of both, but has been here shown as of the priority type.

Each flow control mechanism 120 is nearly identical with that seen in FIG. 2 in that it has its own housing 121 containing a poppet type valve member 35' and a low pressure relief valve 36' laterally adjacent thereto.

The valve member 35' operates in a chamber 37' and its upper end is cooperable with a valve seat 39' to govern communication between an inlet port 51' and a reservoir passage 57'. The reservoir passage opens to the top of the housing, as does the inlet port 51' and a pump port 50' for the low pressure relief valve 36'. A duct 122 connects the inlet port 51' with the outlet end portion of the open center passage 127 in the control valve 123. A passage 42' communicates the bottom of the chamber 37' with the outlet of the low pressure relief valve, and an adjustable spring 43' normally holds the latter closed.

The control valve 123 seen in FIG. 7 has a body 124 containing a pair of valve spools 125 and 126, each of which intersects laterally adjacent upstream and downstream branches of its open center passage 127. The open center passage also constitutes the feeder passage of the series-parallel valve. The upstream end of the open center passage is connected with the valve inlet 128, and its downstream end opens to a port in the underside of the valve body, to one side of an outlet port 129. The port 129 is connected to the reservoir via a duct 130.

The reservoir passage 57' in the flow control mechanism may be connected with the duct 130, as shown, or it may be connected with the reservoir by a separate duct if desired. A duct 131 connects the inlet 128 with the delivery port of the pump; and a branch 132 of duct 131 is connected to the relief valve 36' so that pump output pressure will exert opening force thereon.

Again in this case, the valve member 35' will be moved toward or from its seat in any metering position of either valve spool 125 or 126, to maintain the desired pressure differential across the neutral throttle defined by the actuated spool. This, of course, effects flow of pressure fluid through the open center passage at the constant rate that assures diversion to the selected motor port of the remainder of the pump output fluid entering the valve inlet for operation of the governed motor at a substantially constant speed corresponding to the metering setting of the actuated spool.

The FIG. 8 embodiment of the invention is the same as that just described, except that the inlet of the low pressure relief valve 36' is communicated with the fluid supply line 131 by means of a duct 135, which connects with a passage 132' in the interior of the valve body 124. One end of the passage 132' is communicated with the inlet end portion of the open center passage 127, and its other end opens to the underside of the valve body, as shown.

The spacing of the three ports opening to the top of the housing 121 of the flow control mechanism can be made the same as those which open to the bottom of the valve body 124 in the FIG. 8 embodiment of the invention. This enables the housing 121 of the flow control mechanism to be bolted or otherwise directly secured to the underside of the valve body, with all three of the ports in its top in communication with those at the bottom of the valve body.

From the foregoing description, together with the accompanying drawings, it will be readily apparent to those skilled in the art that this invention provides a simple but efficient flow control mechanism for control valves of the open center type.

Those skilled in the art will appreciate that the invention can be embodied in forms other than as herein disclosed for purposes of illustration.

The invention is defined by the following claims:

1. A control valve for a fluid motor, wherein movement of a valve spool to a metering position across an open center passage effects diversion of part of the source fluid entering the valve inlet to a motor port in the valve, for operation of a fluid motor at a reduced speed, and effects bypass of the remainder of said inlet fluid to an outlet via a spool defined orifice which communicates the inlet and outlet portions of the open center passage, characterized by means operable in said metering position of the spool to maintain fluid flow to the motor port at a substantially uniform rate despite variations in motor load, characterized by:

A. control means in series with the open center passage having a valve member to regulate communication between the outlet and said outlet end of the open center passage in accordance with the pressure drop across said orifice;

B. means to effect movement of said valve member in the direction to restrict said communication in consequence of increase in the pressure differential between the inlet and outlet portions of the open center passage resulting from an increase in the pressure of fluid in the inlet portion of the open center passage;

C. and means to effect movement of said valve member in the non-restricting direction in consequence of the decrease in the pressure differential between the inlet and outlet portions of the open center passage resulting from a decrease in the pressure of fluid in said inlet portion of the open center passage.

2. In combination with a hydraulic control valve of the type having a motor port, an inlet, an outlet, a valve element to selectively communicate the motor port with either the inlet or the outlet, and having an open center passage through which pressure fluid normally flows from the inlet of the valve to its outlet:

A. control means having a differential pressure actuatable valve member movable toward and from a position restricting communication between the open center passage and the outlet and spring urged toward a normal nonrestricting position;

B. means connecting said control means with the outlet portion of the open center passage to thereby cause said valve member to be subjected to a fluid pressure force tending to move the same toward said nonrestricting position;

C. and means connecting the control means with the inlet portion of the open center passage to thereby cause said valve member to be subjected to a fluid pressure force tending to move the same in the restricting direction whenever fluid pressure in said inlet portion of the open center passage rises relatively to the pressure of fluid in the outlet portion of the open center passage.

3. In combination:

A. a fixed displacement pump having an output port;

B. a control valve having an open center passage an upstream portion of which is communicated with the pump output port, a motor port in the valve, and a valve spool actuatable to a metering position across the open center passage to define an orifice through which a limited amount of pump output fluid flows to a portion of the open center passage downstream from the spool and to effect diversion to said motor port of the remainder of the pump output fluid entering said upstream portion of the open center passage;

C. and flow control means connected with said upstream and downstream portions of the open center passage so as to be responsive to the pressure differential therebetween, and having a movable valve member to restrict and so regulate fluid flow through said downstream portion of the open center passage in accordance with variations in the pressure drop across said orifice as to maintain the flow of fluid through the open center passage at a substantially constant rate.

4. The combination of claim 3, wherein said control valve has a plurality of valve spools, each of which is movable to said metering position across the open center passage to communicate an associated motor port with the inlet portion of the open center passage.

5. The combination of claim 4, wherein said control valve is of the series-parallel type in which the open center passage also affords a feeder passage from which pump output fluid is diverted to the selected motor port.

6. The combination of claim 4, wherein said control valve is of the parallel type in which pump output fluid is diverted to a feeder passage separate from the open center passage for flow to the selected motor port in said metering position of the associated valve spool.

7. The combination of claim 3, wherein said flow control means is provided with a housing separate from that of the control valve, and comprises:

A. an annular valve seat through which said downstream portion of the open center passage is communicable with an exhaust outlet;

B. said valve member comprising a poppet one end of which is cooperable with said seat and the other end portion of which is slidably received in a pressure chamber that guides the poppet for movement toward and from said seat;

C. and a low pressure relief valve in said housing having its inlet communication with said upstream portion of the open center passage and its outlet connected with said chamber to deliver fluid thereto at a pressure which is less than that of fluid in said upstream portion of the open center passage by an amount corresponding to the relief setting of the low pressure relief valve.

8. A control valve of the type having an inlet, an outlet, a motor port for connection with a fluid motor, a valve spool movable in a bore from a neutral position to an operating position connecting the motor port with the inlet, and a bypass intersecting the bore and having an inlet portion upstream from the bore connecting with the inlet and an outlet portion downstream from the bore connecting with the outlet, said bypass providing for substantially unrestricted flow of fluid from the inlet to the outlet in the neutral position of the valve spool, and the latter being operable to close off communication between the inlet and outlet portions of the bypass in a full operating position of the spool, wherein the improvement comprises:

A. bypass restricting means rendered effective in a partial operating position of the spool to limit fluid flow through the bypass so as to thereby divert to the motor port a metered amount of fluid from the inlet and to create a differential in pressure between the inlet and outlet portions of the bypass;

B. and a flow control mechanism having fluid pressure responsive valve means to restrict and regulate fluid flow to the outlet from said outlet portion of the bypass in accordance with variations in the pressure differential between the inlet and outlet portions of the bypass in said partial operating position of the valve spool.

9. The control valve of claim 8, wherein said control mechanism comprises:

A. a relief valve having its inlet communicated with that of the control valve and its outlet connected with the control mechanism to deliver fluid thereto at a pressure which is less than that of fluid in the control valve inlet by an amount corresponding to the relief valve setting;

B. and means for translating the pressure of fluid thus delivered to the control mechanism into bypass closing force on the valve means thereof.

10. In combination with a control valve having a body with an open center passage normally communicating the inlet of the valve with an exhaust outlet, and a valve spool which is movable to a flow metering position across the open center passage to limit bypass flow of inlet fluid to the outlet portion of the open center passage and thereby divert a metered amount of inlet fluid to a motor port in the valve for operation of a fluid motor at a selected speed:

A. flow control valve means to restrict and govern fluid flow to the exhaust outlet from the outlet portion of the open center passage;

B. first means operable in said flow metering position of the valve spool for effecting motion of the flow control valve means in the direction to increase flow of fluid to the exhaust outlet from said outlet portion of the open center passage in consequence of decrease in the pressure differential between said inlet and outlet portions of the open center passage;

C. and second means operable in said flow metering position of the valve spool for effecting motion of the flow control valve means in the direction to decrease flow of fluid to the exhaust outlet from said outlet portion of the open center passage in consequence of increase in the pressure differential between said inlet and outlet portions of the open center passage.

11. The combination of claim 10, further characterized by:

A. an annular valve seat through which the outlet portion of the open center passage is communicable with the exhaust outlet;

B. said flow control valve means comprising a poppet one end of which is cooperable with said seat and the other end portion of which is slidably received in a pressure chamber that guides the poppet for movement toward and from said seat;

C. and a relief valve having its inlet connected to the control valve inlet and its outlet connected with said chamber to deliver fluid thereto at a pressure which is less than that of fluid in the control valve inlet by an amount corresponding to the relief setting of the relief valve.

12. The combination of claim 10, further characterized by:

A. a bore in which said flow control valve means is axially slidably received, said bore intersecting the outlet portion of the open center passage, and its opposite ends being closed to define a pressure chamber at each end of said valve means;

B. said second means communicating said inlet with one of said pressure chambers whereby inlet fluid therein can exert force upon said valve means tending to move the same in the direction to restrict communication between the exhaust outlet and the outlet portion of the open center passage;

C. and said first means communicating the outlet portion of the open center passage with the other of said pressure chambers whereby fluid therein can exert force upon said valve means tending to move it in the direction to permit free flow of fluid to the exhaust outlet from said outlet portion of the open center passage.

13. The combination of claim 12, further characterized by a spring in said other chamber to yieldingly urge said valve means in the direction to permit free flow of fluid to the exhaust outlet from the outlet portion of the open center passage.

14. The combination of claim 10, further characterized by:

A. an annular valve seat through which the outlet portion of the open center passage is communicable with the exhaust outlet, said seat facing the exhaust outlet;

B. and said first means comprising an enlarged head on said valve means cooperable with said seat, and upon which fluid in the outlet portion of the open center passage can exert opening force.

15. A control valve of the type having an inlet, an outlet, a motor port for connection with a fluid motor, a valve spool movable in a bore from a neutral position to an operating position connecting the motor port with the inlet, and a bypass intersecting the bore and having an inlet portion upstream from the bore connecting with the inlet and an outlet portion downstream from the bore connecting with the outlet, said bypass providing for substantially unrestricted flow of fluid from the inlet to the outlet in the neutral position of the valve spool, and the latter being operable to close off communication between the inlet and outlet portions of the bypass in a full operating position of the spool, wherein the improvement comprises:

A. bypass restricting means rendered effective in a partial operating position of the spool to limit fluid flow through the bypass so as to thereby divert to the motor port a metered amount of fluid from the inlet and to create a differential in pressure between the inlet and outlet portions of the bypass;

B. a flow control mechanism having fluid pressure responsive valve means to restrict and regulate fluid flow to the outlet from said outlet portion of the bypass in accordance with variations in the pressure differential between the inlet and the outlet portions of the bypass in said partial operating position of the valve spool; and C. said flow control mechanism including means biasing said valve means toward a non-restricting position thereof, means communicating said inlet portion of the bypass with said valve means for directing fluid pressure to act on said valve means in opposition to said biasing means, and said valve means defining passage means communicating said outlet portion of the bypass with said valve means for directing fluid pressure thereto to act on said valve means to urge said valve means toward said non-restricting position.

* * * * *